US008486203B2

(12) United States Patent
Manavbasi

(10) Patent No.: US 8,486,203 B2
(45) Date of Patent: Jul. 16, 2013

(54) CONVERSION COATING AND ANODIZING SEALER WITH NO CHROMIUM

(75) Inventor: Alp Manavbasi, Minden, NV (US)

(73) Assignee: Metalast International, Inc., Minden, NV (US)

( * ) Notice: Subject to any disclaimer, the term of this patent is extended or adjusted under 35 U.S.C. 154(b) by 609 days.

(21) Appl. No.: 12/706,360

(22) Filed: Feb. 16, 2010

(65) Prior Publication Data

US 2010/0314004 A1 Dec. 16, 2010

Related U.S. Application Data

(60) Provisional application No. 61/186,356, filed on Jun. 11, 2009.

(51) Int. Cl.
*C23C 22/48* (2006.01)

(52) U.S. Cl.
USPC ..... 148/247; 148/274; 106/14.11; 106/14.37; 106/14.41

(58) Field of Classification Search
USPC ..... 148/247, 274; 106/14.11, 14.37, 106/14.41
See application file for complete search history.

(56) References Cited

U.S. PATENT DOCUMENTS

| | | | | |
|---|---|---|---|---|
| 5,380,374 | A | 1/1995 | Tomlinson | |
| 5,441,580 | A | 8/1995 | Tomlinson | |
| 5,449,414 | A | 9/1995 | Dolan | |
| 5,584,946 | A | 12/1996 | Karmaschek et al. | |
| 5,868,874 | A | 2/1999 | Rossio | |
| 6,059,867 | A | 5/2000 | Lewis et al. | |
| 6,200,672 | B1 | 3/2001 | Tadokoro et al. | |
| 6,530,999 | B2 | 3/2003 | Meagher et al. | |
| 6,758,916 | B1 | 7/2004 | McCormick | |
| 6,818,313 | B2 * | 11/2004 | Phelps et al. | 428/457 |
| 7,294,211 | B2 | 11/2007 | Sturgill et al. | |
| 7,407,689 | B2 | 8/2008 | Joshi et al. | |
| 7,452,454 | B2 | 11/2008 | Dolan | |
| 2004/0020568 | A1 | 2/2004 | Phelps et al. | |
| 2004/0022951 | A1 | 2/2004 | Marcus | |
| 2004/0170840 | A1 | 9/2004 | Matsukawa et al. | |
| 2005/0067057 | A1 * | 3/2005 | Ishikura et al. | 148/273 |
| 2005/0179010 | A1 | 8/2005 | Lin | |
| 2008/0305341 | A1 | 12/2008 | Plieth et al. | |
| 2008/0314479 | A1 | 12/2008 | Cape | |

* cited by examiner

*Primary Examiner* — Lois Zheng
(74) *Attorney, Agent, or Firm* — Ian F. Burns; ATIP Law

(57) ABSTRACT

Aqueous acidic coating solutions containing a water soluble divalent zinc compound, a complex fluoride compound, and an organic inhibitor for improving the corrosion resistance and adhesive bonding characteristics of aluminum, aluminum alloys, anodic coatings and sacrificial coatings, are disclosed. Suitable organic inhibitors include oximes, such as salicyladoxime, and/or quinolines, particularly 8-hydroxyquinoline, and mixtures thereof.

32 Claims, No Drawings

CONVERSION COATING AND ANODIZING SEALER WITH NO CHROMIUM

CROSS REFERENCES TO RELATED APPLICATIONS

This application claims priority of U.S. provisional patent application No. 61/186,356, filed Jun. 11, 2009. The above referenced application is hereby expressly incorporated by reference in its entirety.

BACKGROUND OF THE INVENTION

The present invention relates to the art of coating and sealing of metals and other solid substrate surfaces for preparing corrosion resistant non-chromium chemical conversion coatings for enhancing the corrosion resistance and adhesive bonding strength of the solid substrate surfaces, more particularly useful for aluminum, aluminum alloys, anodized aluminum, magnesium, zinc, titanium and titanium alloys, ferrous alloys, and galvanized steel, for example.

Aluminum and its alloys have been widely used in aerospace, automotive, and marine industry as structural materials because of their mechanical performance, and their low weight-to-strength ratio. The incorporation of alloying elements such as copper and the subsequent heat treatment lead to the formation of intermetallic compounds within the aluminum matrix. Unfortunately, the electrochemical potential difference between the intermetallic compounds and the aluminum matrix causes the aluminum alloys to be very susceptible to the localized corrosion such as pitting, especially in halide environments. In order to prevent the corrosion, therefore, aluminum surfaces are mostly treated with conversion coatings.

Passivation of aluminum and its alloys is typically done by the chemical or electrolytic conversion coating methods. Chemical conversion coatings are applied through chemical reactions, without externally applied electric potential, between the metal surface and bath solution which convert or modify the metal surface into a protective thin film with desirable functional properties. As a result of this reaction a corrosion-resistant outer layer on the base metal or its oxide becomes an integral part of the metal surface and often simultaneously produces a surface with enhanced paint adhesion. Therefore, the chemical conversion coating bath must include a suitable agent capable of reacting with both the aluminum and aluminum oxide surface film. Additionally, it must form a coating capable of forming an insoluble compound with aluminum and its alloying elements. The formed coating layers may provide corrosion and oxidation protection through galvanic effects or through simply providing a barrier layer to the surrounding corrosive environment. Unlike chemical conversion coatings, electrolytic conversion coatings, such as anodizing, require an electric current passing through the metal component immersed in a chemical bath. Anodic coatings formed on aluminum consist of a very thin non-porous barrier oxide layer, and a relatively thick porous layer. Without any post-treatment (or sealing), the corrosion performance of anodized aluminum largely depends on the properties of the very thin barrier oxide layer.

Among several chemical conversion coating types, hexavalent chromium, Cr(VI), or chromate-containing conversion coatings have been used for a long time because of their good adhesion and corrosion resistance. Similarly, hexavalent Cr(VI) based post-treatment solutions have been used to seal the anodic coatings in order to provide high corrosion performance and paint adhesion. However, solutions containing hexavalent Cr(VI) are highly toxic and adversely affect the environment and human health.

There is, therefore, a need for environmentally green conversion coatings and anodic coating sealers that can provide high corrosion resistance and increase the adhesive bonding strength. Although there are other conversion coatings and seals which do not contain chromium, their corrosion performance and paint adhesion characteristics are not as effective as the hexavalent Cr(VI) based conversion coatings and seals. Another drawback of chromated and non-chromated solutions is the formation of precipitates over time that leads to degradation of coating performance due to material loss in the bath.

Therefore, strict environmental regulations, tight waste disposal standards, and very low PEL (Permissible Exposure Limits) which are set and enforced by OSHA (Occupational Safety & Health Administration), have made the application of hexavalent Cr(VI) prohibitively expensive. Additionally, existing chromium-free corrosion inhibitors do not provide the corrosion resistance at desirable levels. Accordingly, there is a need for an environmentally friendly chemical conversion coating and anodic coating sealer that can provide good corrosion resistance and paint adhesion properties on aluminum substrates.

SUMMARY OF THE INVENTION

The present invention provides aqueous compositions and processes for preparing a corrosion resistant non-chromium coating on bare aluminum substrates or anodized aluminum substrates which comprises treating the substrates with an aqueous solution containing from about 0.01 to about 15 g/l (grams/liter) of a water-soluble divalent zinc compound, at least 0.2 g/l of a complex fluoride compound, and an organic inhibitor which is effective at increasing corrosion protection and reducing precipitation of cationic species over time. The organic inhibitor comprises a chelating group or multidentate ligands. Suitable organic inhibitors for corrosion inhibition include the derivatives of oximes and quinolines, such as salicylaldoxime and 8-hydroxyquinoline, for example, and may be one or the other or a combination thereof provided that the derivative is substantially soluble in water.

For the purposes of the present invention, compositions free of chromium (non-chromium), i.e., in the absence of chromium compounds, shall refer to aqueous compositions containing substantially no chromium ion, that is, less than about 0.001 g/l or 1 ppm (parts per million) by weight, and typically less than about 0.0001 g/l or 100 ppb (parts per billion) by weight.

It is, therefore, an object of the present invention to provide an improved composition for depositing coatings onto aluminum, aluminum alloys, and anodized aluminum that contains no chromium or other highly toxic elements.

It is another object of the present invention to provide a composition and process for treating bare aluminum and aluminum alloy surfaces and for sealing anodized aluminum surfaces which contains divalent zinc compound and organic inhibitors selected the from the groups of oximes and quinolines, such as salicylaldoxime and 8-hydroxyquinoline, to improve the corrosion resistance and adhesion properties of the bare and anodized substrates.

In one embodiment of the present invention, the coating compositions of the present invention may be substantially free of polymer film or resin materials that are used in some conventional coating compositions, for example, conductive polymers, aqueous-resin emulsion materials, and water-soluble and/or water-dispersible resin materials.

It is still a further object of the present invention to provide non-toxic corrosion protection conversion coatings and anodic coating sealer baths based on complex fluoride anions such as hexafluorozirconate, divalent zinc compound, and organic inhibitor wherein cationic species have little or no tendency to precipitate from the solution.

It is a further object of the present invention to treat the aluminum and anodized aluminum surfaces by using various application methods including immersion, spray, brush or wipe-on techniques, for example.

These and other objects will become apparent to those skilled in the art from the description of the invention as follows.

DETAILED DESCRIPTION OF THE INVENTION

Producing a uniform, adherent and corrosion-resistant film growth with low-defect on the aluminum, aluminum alloy, or anodic coatings can be achieved if the surface is cleaned of soil and pre-existing native oxides, which may interfere with the coating process. The surfaces are typically cleaned of organic and inorganic residues by any convenient method known to the art before applying the conversion coating to the surface. Water rinses, for example, may then be used to remove any loose residual material from the surface. After cleaning and rinsing, surface activation can also be done by using any convenient deoxidizing and/or desmutting methods known to the art. All these steps applied before the conversion coating bath treatment are referred to herein as "pre-treatment".

After the pre-treatment, the aluminum, aluminum alloy, or anodized aluminum surface is treated with the conversion coating bath (for a time sufficient to coat the surface) based on divalent zinc compound, complex fluoride compound, and organic inhibitors. Various methods of treating the aluminum surface with the conversion coating solution commonly used in the metal surface treatment or coating art are acceptable. For example, the aluminum, aluminum alloy, and anodized aluminum surfaces can be treated by dipping, spraying and roller coating. The treatment of the metal surfaces can be done at temperatures ranging from ambient up to the boiling point.

One embodiment of the present invention provides a conversion coating comprising divalent zinc compound, complex fluoride anions, and organic inhibitor to provide a pH of about 2.0 to about 6.0, and preferably from about 3.4 to 4.0. More particularly, conversion coatings of the present invention comprise an aqueous solution of from about 0.01 g/l (grams per liter) up to the solubility limit, generally from 0.1 to 15 g/l, of a divalent zinc compound; from 0.2 to 20 g/l (generally between 1.0 and 18.0 g/l) of one or more of the complex fluoride compounds; and from 0.01 g/l up to the solubility limit, generally from 0.05 to 0.5 g/l, of an organic inhibitor.

Suitable divalent zinc compounds include, for example, zinc sulfate, zinc carbonate, zinc fluoride, zinc chloride and zinc silicate, and may be one or the other or the mixtures thereof. Water-soluble zinc sulfate works well for this application.

Complex fluoride anions hexafluorzirconate ($ZrF_6^{-2}$) and hexafluorotitanate ($TiF_6^{-2}$) are suitable fluoride sources for this application, and hexafluorosilicates ($SiF_6^{-2}$) can also be used. The potassium, lithium, sodium, and ammonium salts of the aforementioned anions work well for this application, preferably potassium. Other complex fluoride anions, including, but not limited to, fluoroaluminates (e.g., $AlF_4^{-1}$ or $AlF_6^{-3}$), fluoroborates (e.g., $BF_4^{-1}$), fluoroantimonates (e.g., $SbF_6^{-1}$) fluorostannates ($SnF_6^{-2}$), fluorogallates (e.g., $GaF_4^{-1}$), fluoroindates (e.g., $InF_4^{-1}$), fluorophosphates ($PF_6^{-1}$), fluoroarsenates (e.g., $AsF_6^{-1}$), fluroargentates (e.g., $AgF_3^{-1}$ or $AgF_4^{-2}$), fluorogermanates (e.g., $GeF_6^{2-}$), fluorobismuthates (e.g., $BiF_6^{-1}$), fluoroselenates (e.g., $SeF_6^{-1}$), fluorotellurates (e.g., $TeF_6^{2-}$ or $TeOF_5^{-1}$), fluorocuprates (e.g., $CuF_3^{-1}$ or $CuF_4^{-2}$), fluorosulfates (e.g., $SF_6^{-2}$), fluorozincates (e.g., $ZnF_4^{-2}$), fluorohafnates (e.g., $HfF_6^{-2}$), fluorotungstates (e.g., $WF_6^{-1}$), fluorovanadates (e.g., $VF_7^{-2}$), fluoroniobates (e.g., $NbF_7^{-2}$), fluorotantalates (e.g., $TaF_7^{-2}$), fluorocerates (e.g., $CeF_6^{-2}$ or $CeF_6^{-3}$), fluoromolybdates (e.g., $MoF_6^{-3}$), fluorocabaltates (e.g., $CoF_6^{-2}$), fluoroyttrates (e.g., $YF_6^{-3}$), fluorolanthanates (e.g., $LaF_6^{-3}$), fluoromanganates (e.g., $MnF_6^{-2}$), fluoroferrates (e.g., $FeF_6^{-3}$), and fluoronickelates (e.g., $NiF_6^{-3}$), are also suitable fluoride sources with water-soluble potassium, sodium, lithium, or ammonium salts of these anions.

Moreover, inorganic fluorides such as potassium fluoride (KF), sodium fluoride (NaF), lithium fluoride (LiF), ammonium fluoride ($NH_4F$), hydrofluoric acid (HF), potassium hydrogen fluoride ($KHF_2$), sodium hydrogen fluoride ($NaHF_2$), lithium hydrogen fluoride ($LiHF_2$) and ammonium dihydrogen fluoride ($NH_4HF_2$), can also be used as a fluoride source. Similarly, organic compounds which can release the fluoride ions in acidic aqueous solutions can also be used as fluoride sources. In addition to the fluorides, other halides such as chlorides ($Cl^-$), bromides ($Br^-$) and iodides ($I^-$) can also be used, however, their efficiency in removing the natural surface oxide layer is not as great as the fluorides.

Organic inhibitors can be selected from the oximes such as salicylaldoxime, benzaldoxime, methylbenzamide oxime, (trifluoromethyl)benzamidoxime and 3,5-bis(trifluoromethyl)benzamidoxime, for example, preferably salicylaldoxime. Another group of suitable organic inhibitors are quinolines such as 8-hydroxyquinoline, 8-hydroxyquinoline-5 sulfonic acid, 8-quinoline hemisulfate salt hemihydrate and 2-quinolinethiol, preferably 8-hydroxyquinoline. Additional suitable organic inhibitors include quinaldic acid and xanthurenic acid. A mixture of these different organic compounds can also be used to provide corrosion inhibition and bath stability.

In addition to the organic inhibitors noted above, the following corrosion inhibiting organic compounds and their derivatives may be used in aqueous compositions of the present invention: amines and secondary aromatic amines with or without substitution in the 5-position by chloro, bromo, nitro and methyl substituents (for example, N-phenyl-1,4-phenylenediamine, ethylene diamine, N,N'-p-phenylen-bis(3-methoxysalicylidenimine), N-[(2-hydroxy-3-methoxy-phenyl)methylene]-histidine and mixtures thereof; amino acids such as cysteine, tryptophan and mixtures of thereof; azoles such as benzotriazole, tetrazole, 2-mercaptobenzothiazole, 2-mercaptobenzimidazole, 2-amino-5-mercapto-1,3,4-thiadazole, 5-phenyl-tetrazole, 5-amino-tetrazole and mixtures thereof; thiole group compounds such as derivatives of benzenethiol (for example, 4-fluorobenzenethiol, 4-acetamidobenzenethiol, 4-isopropylbenzenethiol, 1,3,4-thiadiazole-2,5-dithiol and mixtures thereof); triphenylmethane derivatives such as fuchsin basic and fuchsin acid salt and mixtures thereof; and organophospho compounds, such as triethylphosphate, triphenyl phosphate, diethyl aminomethyl phosphonic acid, ethyl imido (methylene)phosphonic acid and mixtures thereof.

Additional corrosion inhibiting compounds that may be used in aqueous compositions of the present invention include phosphate compounds (phosphoric acid and polyphosphate, for example), ethyl xanthate, sodium dodecysulfate, phthalazin derivatives, γ-pyrodiphenone, tannins, substituted uracils, propargyl alcohol, aniline derivatives and purine.

Typically, corrosion testing was conducted on bare aluminum and aluminum alloy substrates by immersion in conversion coating baths after cleaning and surface activation (optional) steps. On the other hand, anodized aluminum parts were rinsed and then immersed in the conversion coating bath. Anodic coating baths can be sulfuric, phosphoric, oxalic-based, for example. After conversion coating treatment of parts (bare or anodized), the parts were immersed in deionized water and then dried. Air forced drying, air drying, heating, for example, can be used to remove the excess water from the surface of the sealed part.

The invention will be further detailed by reference to the following non-limiting examples. It should be understood, however, that many variations and modifications can be made while remaining within the scope of the present invention.

Example 1

A stable acidic conversion coating bath solution was prepared by dissolving 3.2 g/l potassium hexafluorozirconate, 2.4 g/l zinc sulfate, and 0.2 g/l 8-hydroxyquinoline in distilled/deionized water. The pH of the solution was in the range of 3.4 to 4.0. Anodized aluminum panels were immersed into the bath solution for 20 minutes.

The corrosion resistance properties were evaluated by exposing the panels to natural salt fog test according to ASTM (American Society for Testing and Materials) B 117.

General corrosion resistance against acids was tested by using the Acid Dissolution Test according to ASTM B 680.

There was no sign of corrosion after 1000 hours of salt spray application and only one pit was observed after 5040 hours of salt spray exposure. Total exposed area was 32 $in^2$ (square inches). There was 0.0 $mg/dm^2$ (milligrams/square decimeter) of weight loss after the Acid Dissolution Test.

Example 2

A stable acidic conversion coating bath solution was prepared by dissolving 3.2 g/l potassium hexafluorozirconate, 2.4 g/l zinc sulfate, and 0.2 g/l salicylaldoxime. The pH of the bath solution was in the range of 3.4 to 4.0. Anodized aluminum panels were immersed into the bath solution for 20 minutes. There was no sign of corrosion after 1000 hours of salt spray exposure.

Example 3

A stable acidic conversion coating bath solution was prepared by dissolving 5 g/l potassium hexafluorozirconate, 4 g/l zinc sulfate, and 0.25 g/l 8-hydroxyquinoline. The pH of the solution was in the range of 3.4 to 4.0. The anodized aluminum panels were treated by immersing into the bath solution for 20 minutes.

The corrosion resistance properties were evaluated by exposing the sealed panels to natural salt fog test according to ASTM B 117. General corrosion resistance against acids was tested by using the Acid Dissolution Test according to ASTM B 680. There was no sign of corrosion after 1000 hours of salt spray exposure. There was less than 10 $mg/dm^2$ of weight loss after the Acid Dissolution Test. The coating weight of the deposited coatings on bare aluminum substrates was found to be at least 0.14 mg/sq. in. (milligrams per square inch) of surface area.

Example 4

The acidic conversion coating bath solutions of Examples 1, 2 and 3 were used to coat bare aluminum (not anodized) substrates for use in the Paint Adhesion (Wet Tape) test per ASTM-D3359 (Method A). After cleaning the surfaces (previously described), the bare aluminum panels were immersed in the conversion coating solutions for 10 minutes, rinsed and evaluated.

Coating bath formulation A (3.2 g/l potassium hexafluorozirconate, 2.4 g/l zinc sulfate, and 0.2 g/l 8-hydroxyquinoline).

Coating bath formulation B (3.2 g/l potassium hexafluorozirconate, 2.4 g/l zinc sulfate, and 0.2 g/l salicylaldoxime).

Coating bath formulation C (5 g/l potassium hexafluorozirconate, 4 g/l zinc sulfate, and 0.25 g/l 8-hydroxyquinoline).

Test panels of bare aluminum exposed to formulations A, B and C prior to subjection to the Paint Adhesion (Wet Tape) test provided excellent results (4A or 5A classifications) according to ASTM-D3359, Method A: no peeling or only trace peeling along incisions of the test panels.

I claim:

1. An aqueous coating composition for treatment of surfaces of metals and solid substrates, comprising:

(A) at least 0.01 gram/liter of at least one water-soluble divalent zinc compound;

(B) at least 0.2 gram/liter of at least one complex fluoride compound;

(C) at least 0.01 gram/liter of at least one chelating- or multidentate ligand-containing organic compound selected from one or more of salicylaldoxime, benzaldoxime, methylbenzamide oxime, (trifluoromethyl) benzamidoxime and 3,5-bis(trifluoromethyl)benzamidoxime; and (D) wherein the aqueous coating composition is substantially free of chromium ion.

2. The aqueous coating composition of claim 1 further comprising at least 0.01 gram/liter of at least one corrosion inhibiting organic compound.

3. The aqueous coating composition of claim 1 comprising a pH from 2.0 to 6.0.

4. The aqueous coating composition of claim 1 wherein the divalent zinc compound is selected from one or more of zinc sulfate, zinc carbonate, zinc fluoride, zinc chloride and zinc silicate.

5. The aqueous coating composition of claim 1 comprising from 0.01 to 15 grams/liter of the divalent zinc compound.

6. The aqueous coating composition of claim 1 wherein the complex fluoride compound is selected from one or more of hexafluorzirconate, hexafluorotitanate and hexafluorosilicate salts.

7. The aqueous coating composition of claim 6 wherein the complex fluoride compound is selected from one or more of potassium, lithium, sodium and ammonium salts.

8. The aqueous coating composition of claim 1 comprising from 1 to 18 grams/liter of the complex fluoride compound.

9. The aqueous coating composition of claim 1 comprising from 0.05 to 5 grams/liter of the chelating- or multidentate ligand-containing organic compound.

10. The aqueous coating composition of claim 1 comprising less than 0.001 gram/liter of chromium ion.

11. The aqueous coating composition of claim 1 that is substantially free of polymer film and resin materials.

12. A method for coating solid substrates in the absence of chromium compounds to provide corrosion-resistant coated substrates, the method comprising:

(A) cleaning a solid substrate to free the substrate of organic or inorganic residue;

(B) rinsing the solid substrate with water after cleaning; and (C) treating the cleaned and rinsed solid substrate with an aqueous composition comprising a water-soluble divalent zinc compound, at least one complex fluoride compound, and from 0.05 to 5 grams/liter of at least one chelating- or multidentate ligand-containing organic compound selected from one or more of salicylaldoxime and 8-hydroxyquinoline, wherein the aqueous composition is substantially free of chromium ion.

13. The method of claim 12 wherein treating the cleaned and rinsed solid substrate comprises one or more treatments selected from immersion, spraying, brushing and wiping the solid substrate with the aqueous composition.

14. The method of claim 12 comprising treating the cleaned and rinsed solid substrate with an aqueous composition comprising from 0.01 to 15 grams/liter of zinc sulfate as the water-soluble divalent zinc compound.

15. The method of claim 12 comprising treating the cleaned and rinsed solid substrate with an aqueous composition comprising from 1 to 18 grams/liter of potassium hexafluorozirconate as the complex fluoride compound.

16. The method of claim 12 wherein treating the cleaned and rinsed solid substrate comprises treating solid substrates having surfaces selected from one or more of aluminum, aluminum alloy, anodized aluminum, magnesium, zinc, titanium and titanium alloy, ferrous alloy, and galvanized steel surfaces.

17. An aqueous coating composition for treatment of surfaces of metals and solid substrates, comprising:

(A) at least 0.01 gram/liter of at least one water-soluble divalent zinc compound;

(B) at least 0.2 gram/liter of at least one complex fluoride compound;

(C) at least 0.01 gram/liter of at least one chelating- or multidentate ligand-containing organic compound selected from one or more of 8-hydroxyquinoline, 8-hydroxyquinoline-5 sulfonic acid, 8-quinoline hemisulfate salt hemihydrate and 2-quinolinethiol; and (D) wherein the aqueous coating composition is substantially free of chromium ion.

18. The aqueous coating composition of claim 17 further comprising at least 0.01 gram/liter of at least one corrosion inhibiting organic compound.

19. The aqueous coating composition of claim 17 comprising a pH from 2.0 to 6.0.

20. The aqueous coating composition of claim 17 wherein the divalent zinc compound is selected from one or more of zinc sulfate, zinc carbonate, zinc fluoride, zinc chloride and zinc silicate.

21. The aqueous coating composition of claim 17 comprising from 0.01 to 15 grams/liter of the divalent zinc compound.

22. The aqueous coating composition of claim 17 wherein the complex fluoride compound is selected from one or more of hexafluorzirconate, hexafluorotitanate and hexafluorosilicate salts.

23. The aqueous coating composition of claim 22 wherein the complex fluoride compound is selected from one or more of potassium, lithium, sodium and ammonium salts.

24. The aqueous coating composition of claim 17 comprising from 1 to 18 grams/liter of the complex fluoride compound.

25. The aqueous coating composition of claim 17 comprising from 0.05 to 5 grams/liter of the chelating- or multidentate ligand-containing organic compound.

26. The aqueous coating composition of claim 17 comprising less than 0.001 gram/liter of chromium ion.

27. The aqueous coating composition of claim 17 that is substantially free of polymer film and resin materials.

28. A method for coating solid substrates in the absence of chromium compounds to provide corrosion-resistant coated substrates, the method comprising:

(A) cleaning a solid substrate to free the substrate of organic or inorganic residue;

(B) rinsing the solid substrate with water after cleaning; and (C) treating the cleaned and rinsed solid substrate with an aqueous composition comprising a water-soluble divalent zinc compound, at least one complex fluoride compound, and from 0.05 to 5 grams/liter of at least one chelating- or multidentate ligand-containing organic compound selected from one or more of benzaldoxime, methylbenzamide oxime, (trifluoromethyl)benzamidoxime, 3,5-bis(trifluoromethyl)benzamidoxime, 8-hydroxyquinoline-5 sulfonic acid, 8-quinoline hemisulfate salt hemi-hydrate and 2-quinolinethiol; wherein the aqueous composition is substantially free of chromium ion.

29. The method of claim 28 wherein treating the cleaned and rinsed solid substrate comprises one or more treatments selected from immersion, spraying, brushing and wiping the solid substrate with the aqueous composition.

30. The method of claim 28 comprising treating the cleaned and rinsed solid substrate with an aqueous composition comprising from 0.01 to 15 grams/liter of zinc sulfate as the water-soluble divalent zinc compound.

31. The method of claim 28 comprising treating the cleaned and rinsed solid substrate with an aqueous composition comprising from 1 to 18 grams/liter of potassium hexafluorozirconate as the complex fluoride compound.

32. The method of claim 28 wherein treating the cleaned and rinsed solid substrate comprises treating solid substrates having surfaces selected from one or more of aluminum, aluminum alloy, anodized aluminum, magnesium, zinc, titanium and titanium alloy, ferrous alloy, and galvanized steel surfaces.

* * * * *